US006939177B2

(12) United States Patent
Kato et al.

(10) Patent No.: US 6,939,177 B2
(45) Date of Patent: Sep. 6, 2005

(54) CONNECTOR FOR PLURAL MATING CONNECTORS HAVING DIFFERENT SHAPES OF INTERFACES

(75) Inventors: Nobukazu Kato, Fussa (JP); Isao Igarashi, Akishima (JP); Koji Hayashi, Tachikawa (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 207 days.

(21) Appl. No.: 10/187,684

(22) Filed: Jul. 2, 2002

(65) Prior Publication Data

US 2003/0008566 A1 Jan. 9, 2003

(30) Foreign Application Priority Data

Jul. 4, 2001 (JP) ..... 2001-203992

(51) Int. Cl.[7] ..... H01R 25/00
(52) U.S. Cl. ..... 439/638; 439/607
(58) Field of Search ..... 439/607, 638, 439/639

(56) References Cited

U.S. PATENT DOCUMENTS 4,597,631 A 7/1986 Flores
5,234,353 A * 8/1993 Scholz et al. ..... 439/289
5,387,134 A * 2/1995 Bryce et al. ..... 439/660
5,685,739 A * 11/1997 Davis et al. ..... 439/607
6,024,607 A * 2/2000 Wahl ..... 439/639
6,139,367 A * 10/2000 Yeh ..... 439/609
6,190,208 B1 2/2001 Villain
6,193,555 B1 2/2001 Chang
6,231,390 B1 * 5/2001 Chang ..... 439/607
6,364,699 B1 * 4/2002 Hwang et al. ..... 439/555
6,558,201 B1 * 5/2003 Begley et al. ..... 439/638
6,758,685 B1 * 7/2004 Huang et al. ..... 439/79
6,758,697 B1 * 7/2004 Wu ..... 439/638
2002/0048992 A1 * 4/2002 Wang et al. ..... 439/607

FOREIGN PATENT DOCUMENTS

EP 0 701 303 3/1996

* cited by examiner

*Primary Examiner*—Hae Moon Hyeon
(74) *Attorney, Agent, or Firm*—Michael Best & Friedrich LLP

(57) ABSTRACT

A partition mechanism is arranged in a shell of a receptacle connector so that a connector interface defined by the shell is partitioned into two interface portions, one of which has a shape different from the other. Therefore a mating connector for the connector can be connected with one or two interface portions, depending on a shape of a connector interface of the mating connector. In an example, a plug connector for high resolution signals is connected with two interface portions of the receptacle connector, while another plug connector for low resolution signals is connected with only one interface portion of the receptacle connector.

12 Claims, 15 Drawing Sheets

CONNECTOR FOR PLURAL MATING CONNECTORS HAVING DIFFERENT SHAPES OF INTERFACES

BACKGROUND OF THE INVENTION

This invention relates to a connector, in particular, to a connector for use in high-rate serial transmission for video stream.

As typical ones of high-rate serial transmission techniques for video signals, TMDS, LVDS and GVIF are known. TMDS stands for Transition Minimized Differential Signaling, which is a standard as to a video data transmission between a general computer and its monitor or display. In TMDS standard, data transmission is carried out through two signal lines, negative and positive lines, and a ground line. LVDS stands for Low Voltage Differential Signaling, which is one of high-rate serial transmission systems and is mainly used as an input interface for a liquid crystal panel installed in a notebook computer. In LVDS system, data are transmitted in the form of low amplitude differential signals. GVIF stands for Gigabit Video Interface, which is one of high-rate serial transmission systems and is often used as an input interface for a display mounted on a vehicle. In GVIF system, differential signals are transmitted through only one pair of signal lines.

In a field of high-rate serial transmission for video signal, the specific number of channels is selected depending on whether a display is used in a low resolution mode or high resolution mode. Specifically, the number of channels is small for a low resolution display, while the number of channels is large for high resolution display. Because the number of channels corresponds to the number of signals or signal pins of a connector in a serial transmission system, the difference in the number of channels makes an existence of two different types of connectors: connector for low resolution transmission and connector for high resolution transmission.

Note that a connector for low resolution transmission cannot be used in high resolution transmission because the number of channels, namely, the number of signal pins is short for high resolution transmission. On the other hand, a connector for high resolution transmission can in theory be used in low resolution transmission, but there is a problem that the size of a connector for high resolution transmission is bigger than one of a connector for low resolution transmission.

In addition, two types of connectors are not compatible with each other. Therefore, if a user plans to connect a low resolution display with an instrument producing high resolution signals, the connection is required to further comprise a dongle connector or to use a special connector cable having different types of connectors on its opposite ends. Similar problem is of course occurred in the connection between a high resolution display and an instrument producing low resolution signals. Hereinafter, an instrument or apparatus that can produce high resolution signals is referred to as a high resolution instrument, while an instrument or apparatus that can produce low resolution signals is also referred to as a low resolution instrument.

As apparent from the above description, there is a need for a connector compatible between low resolution transmission and high resolution transmission.

SUMMARY OF THE INVENTION

This invention therefore provides a connector having a plurality of signal pins which can be connected with a mating connector having the same number of contact pins corresponding to and connected to the signal pins of the connector, and which can also reliably be connected with another mating connector having contact pins corresponding to and connected to ones selected from the signal pins of the connector.

Typically, this invention provides a connector having signal pins corresponding to high resolution transmission, which can be connected to a mating connector having contact pins corresponding to the high resolution transmission and which also can be connected with another mating connector for low resolution transmission.

According to one aspect of the present invention, a connector comprising: a plurality of contacts; an insulator supporting the plurality of contacts; a shell surrounding the contacts and the insulator and defining a connector interface; and a partition mechanism arranged to partition the connector interface into a plurality of interface portions, one of the interface portions having a shape different from another one of the interface portions. Thus, a mating connector for the connector is allowed to be connected with one or more the interface portions, depending on a shape of a connector interface of the mating connector.

The partition mechanism may be formed integrally with the insulator, or alternatively, it may be formed integrally with the shell.

According to an embodiment, the partition mechanism may comprise a separate partitioning piece not integrally with said insulator and said shell. The partitioning piece may have a lug and the shell has a slit where the lug is fittable to be fixed to the shell.

According to another embodiment, the partitioning piece can be made of the same material as one of said insulator and said shell.

Further, the partition mechanism may consist of a plurality of partitioning pieces.

In a connector according to another embodiment, the insulator, the shell and the partition mechanism are designed and arranged so as to be suitable for use in a serial transmission system.

In a connector according to a different embodiment, the contacts, the insulator, the shell and the partition mechanism are designed and arranged so as to be suitable for use in a TMDS, LVDS or GVIF system.

In a connector according to a further different embodiment, the contacts, the insulator, the shell and the partition mechanism are designed and arranged for a case where a mating connector for the connector is connected to a graphic display device.

In the connector according to this invention, the partition mechanism may be designed and arranged so that a mating connector can be smoothly and securely guided to the connector in a connection process.

The shell may be designed so that one of the interface portions is arranged in the same plane as another one of the interface portions.

The connector according to this invention may further comprise at least one contact portion on an inner surface of the shell for establishing secure contact between the shell of the connector and the shell of the mating connector, when the mating connector is inserted into the connector.

According to an aspect of this invention, a receptacle connector is provided which comprises a plurality of contacts, an insulator supporting the plurality of contacts, and a shell surrounding the contacts and the insulator. The shell defines a plurality of interface portions to be connected with at least one mating connector. One of the interface portions has a shape different from another one of the interface portions.

According to another aspect of this invention, a plug connector is provided which has a connector interface comprising at least two interface portions. One of the interface portions has a shape different from another one of the interface portions.

DESCRIPTION OF PREFERRED EMBODIMENTS

Before explanation of embodiments of the present invention, description is made about a general configuration and problems in the prior art, for the easily understanding of the embodiments.

Figure 1:
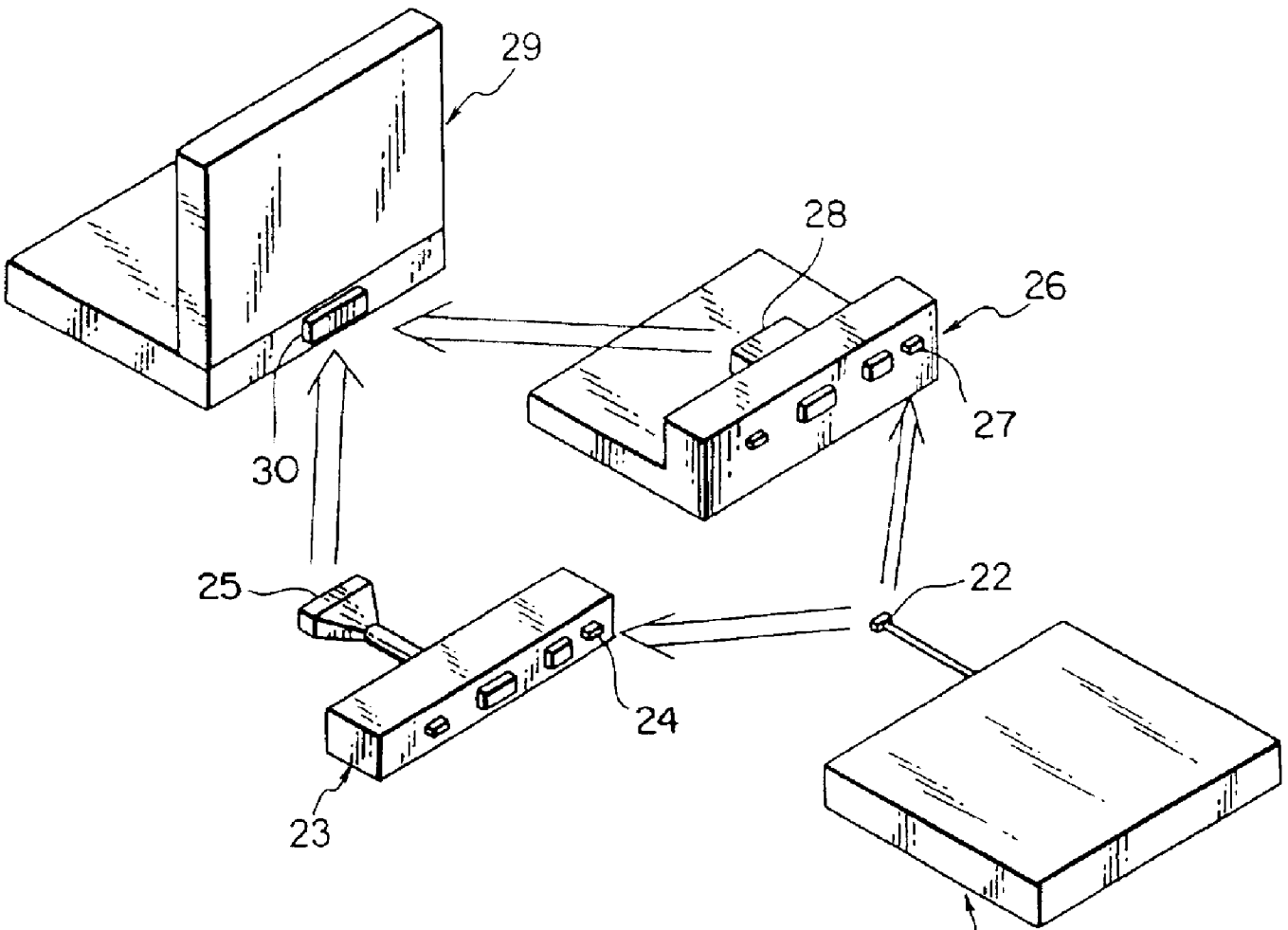
FIG. 1 is a view schematically showing a general relation of configuration or connection between a notebook computer and other components.

Referring to FIG. 1, a peripheral device 21 is connected to a notebook computer 29 through a port-replicator 23 or a docking station 26 in some cases where a connector 22 of the peripheral device 21 is different in size from a connector 30 of the notebook computer 29. Explaining in detail the case of using the port-replicator 23, the connector 22 of the peripheral device 21 is connected to a connector 24 of the port-replicator 23 while another connector 25 of the port-replicator 23 is connected to the connector 30 of the notebook computer 29, so that the connection is established between the notebook computer 29 and the peripheral device 21. Similarly, in the case of using the docking station 26, the connector 22 of the peripheral device 21 is connected to a connector 27 of the docking station 26 while another connector 28 of the docking station 26 is connected to the connector 30 of the notebook computer 29, so that the connection is established between the notebook computer 29 and the peripheral device 21.

Note here that, according to the prior art, the connector 22 cannot be directly connected to the connector 30 because of the different sizes of the connectors 20, 30. That is to say, the port-replicator 23 or the docking station 26 is the necessity of the connection between the peripheral device 21 and the notebook computer 29 in the prior art. This makes a user inconvenient in a certain case.

Figure 2:
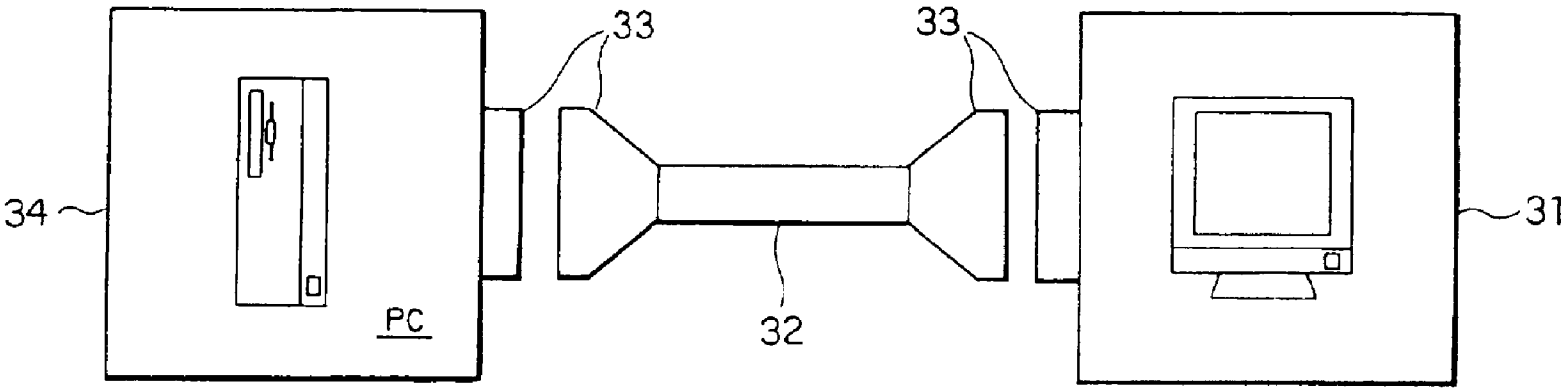
FIG. 2 is a view schematically showing a general connection between a high resolution display and a high resolution instrument.
Figure 3:
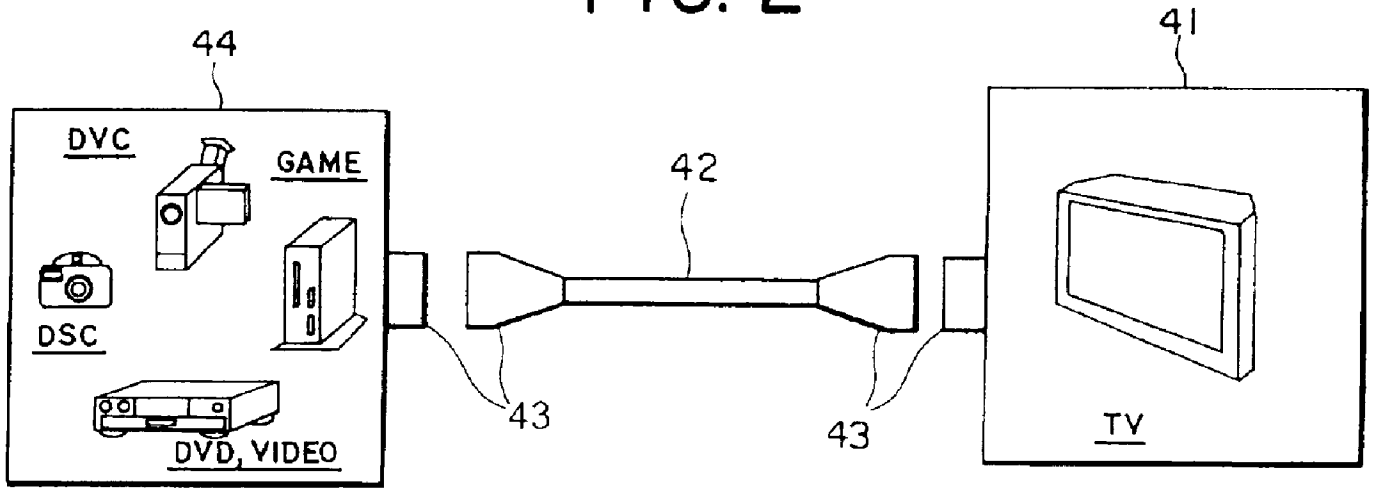
FIG. 3 is a view schematically showing a general connection between a low resolution display and a low resolution instrument.

With reference to FIGS. 2 to 5, further explanation is made about another problem in the prior art. In general, a high resolution display 31 is connected to a high resolution instrument 34 through a cable 32 which is for high resolution signals and which has two connectors 33 for high resolution transmission on the opposite ends thereof, as shown in FIG. 2. Similarly, a low resolution display 41 is connected to a low resolution instrument 44 through a cable 42 which is for low resolution signals and which has two connectors 43 for low resolution transmission on the opposite ends thereof, as shown in FIG. 3. The high resolution instrument 34 is for example a personal computer, while the high resolution display 31 is for example an LCD or CRT monitor for computer. The low resolution instrument 44 is for example a digital video camera, a digital still camera, a DVD player, a video player, or an instrument for game, while the low resolution display 41 is for example a normal TV monitor.

Figure 4:
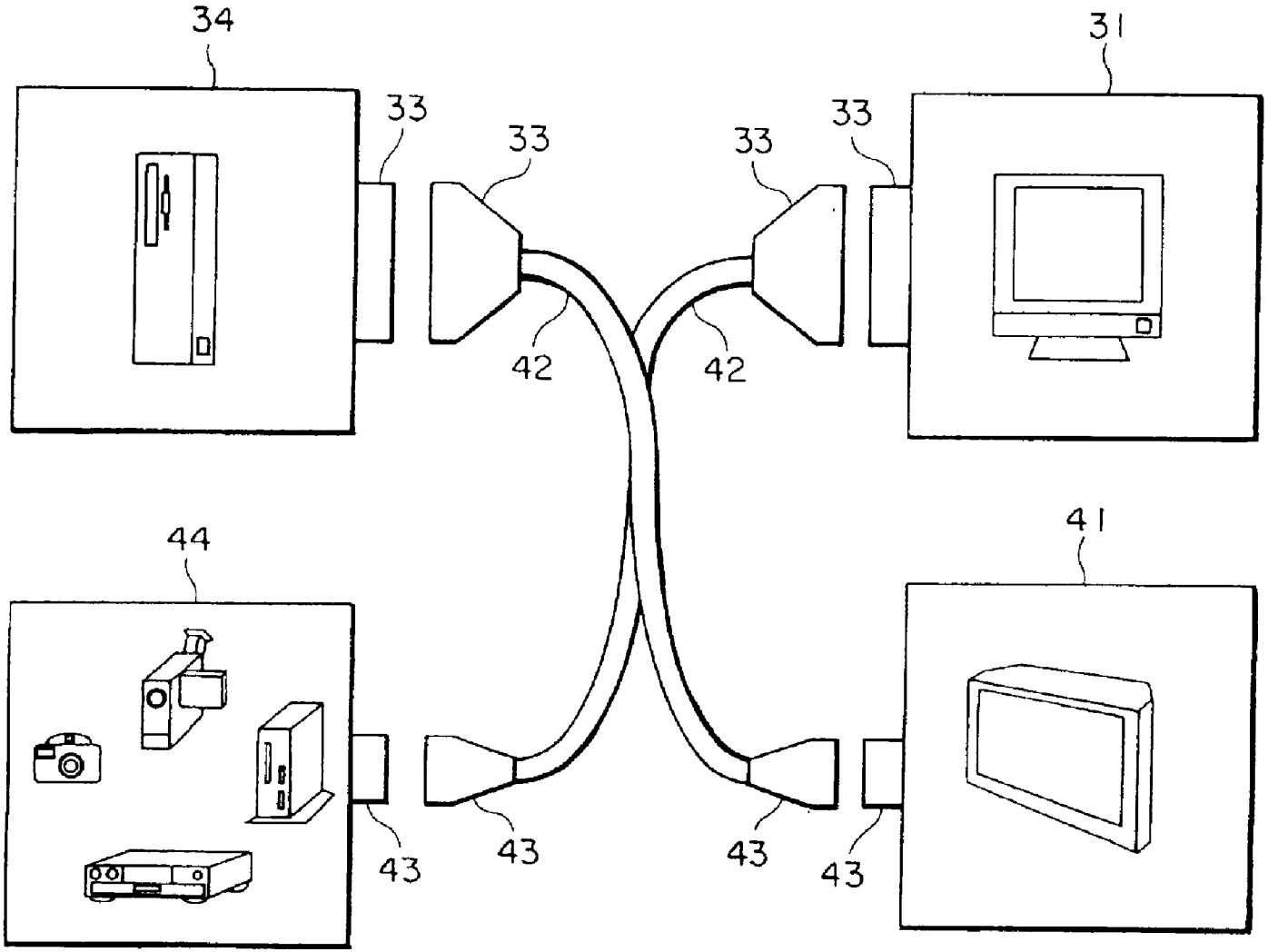
FIG. 4 PRIOR ART
FIG. 4 is a view schematically showing connections in the prior art, one of which relates to the connection between a low resolution display and a high resolution instrument, while the other relates to the connection between a high resolution display and a low resolution instrument.
Figure 5:
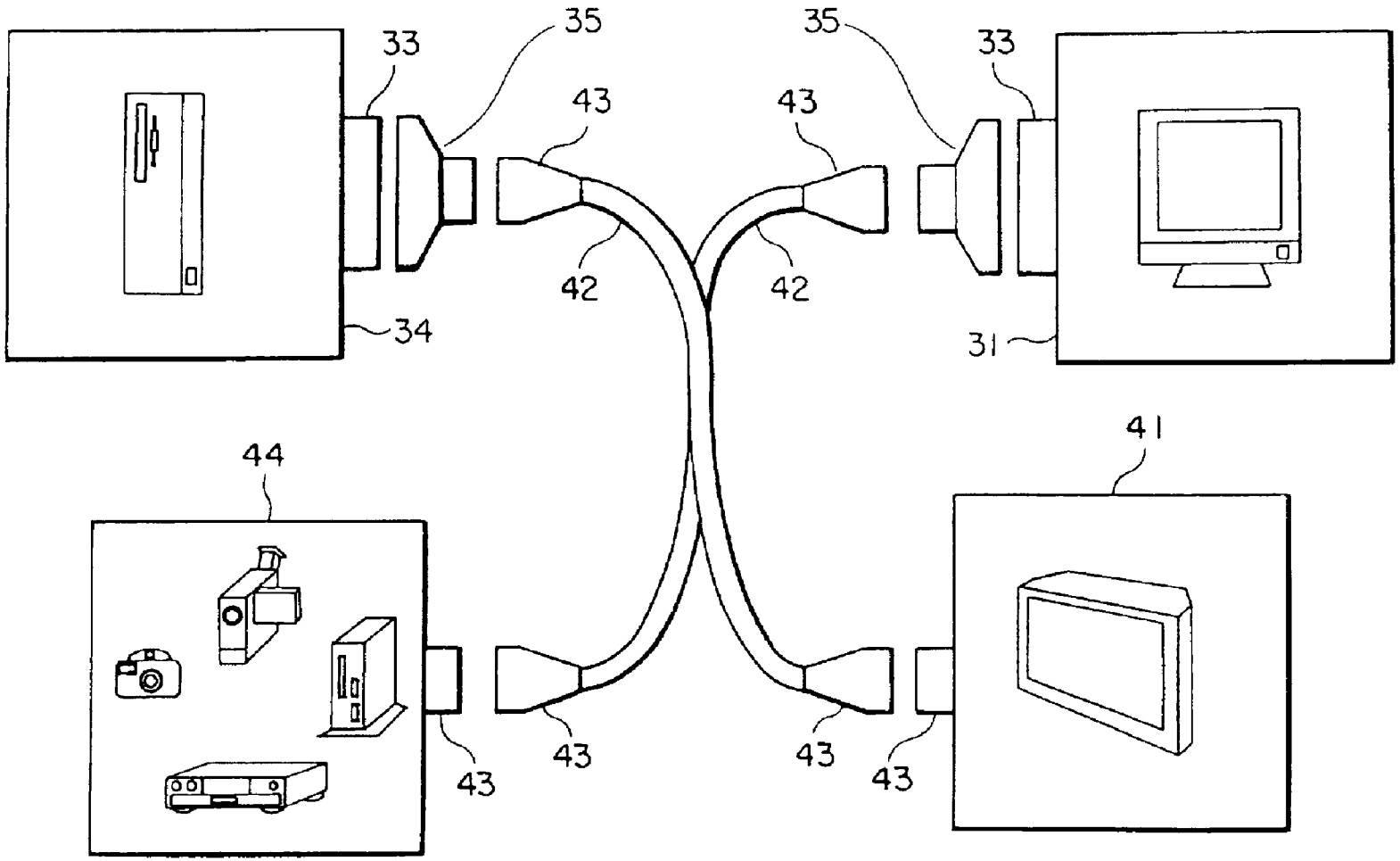
FIG. 5 PRIOR ART
FIG. 5 is another view schematically showing connections in the prior art, one of which relates to the connection between a low resolution display and a high resolution instrument, while the other relates to the connection between a high resolution display and a low resolution instrument.

Consider here that a user wants to connect the high resolution instrument 34 to the low resolution display 41, or to connect the low resolution instrument 44 to the high resolution display 31 in accordance with the prior art. In FIGS. 4 and 5, the exemplary solutions in the prior art are shown. In the solution illustrated in FIG. 4, the instruments and the displays are connected to each other through the cable 42 having different types of connectors 33, 43 on the opposite ends thereof. In the solution illustrated in FIG. 5, the instruments and the displays are connected to each other by using dongle connectors 35. This is because the connector 33 is not compatible with the connector 43 in the prior art.

However, the above-mentioned problems are solved by the present invention. Now, explanation will be in detail made about embodiments of the present invention with reference to FIGS. 6 to 18.

Figure 6:
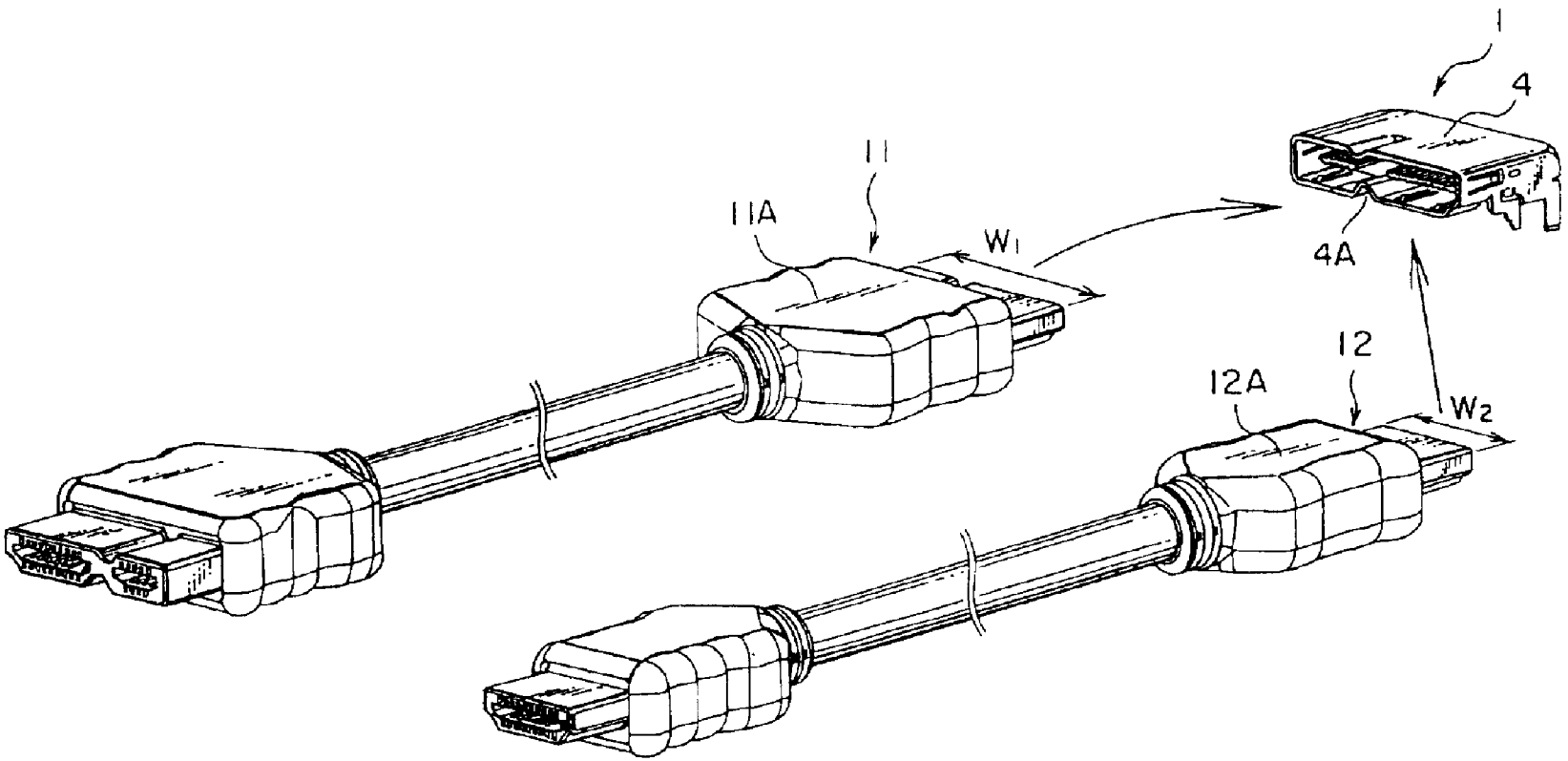
FIG. 6 is a view schematically showing a receptacle connector according to a first embodiment of the present invention and two plug connectors which can be inserted and connected to the receptacle connector.
Figure 7:
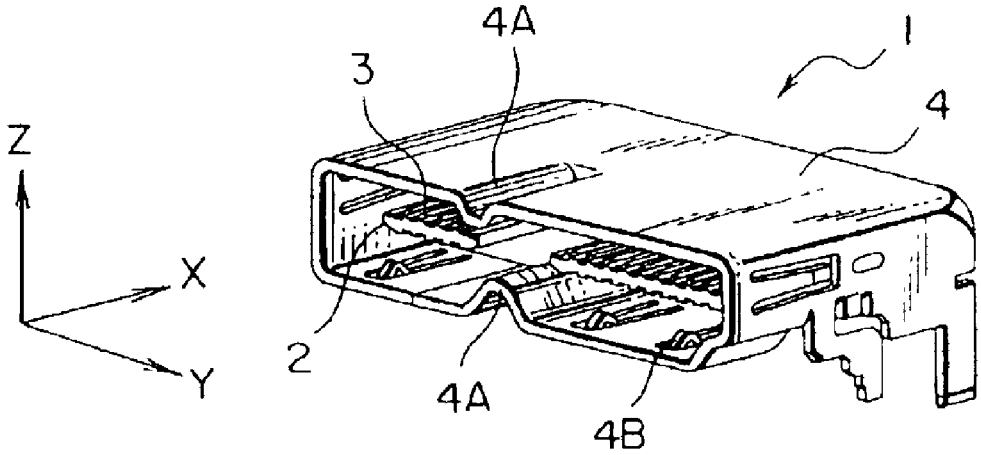
FIG. 7 is a perspective view showing the receptacle connector according to the first embodiment.
Figure 8:
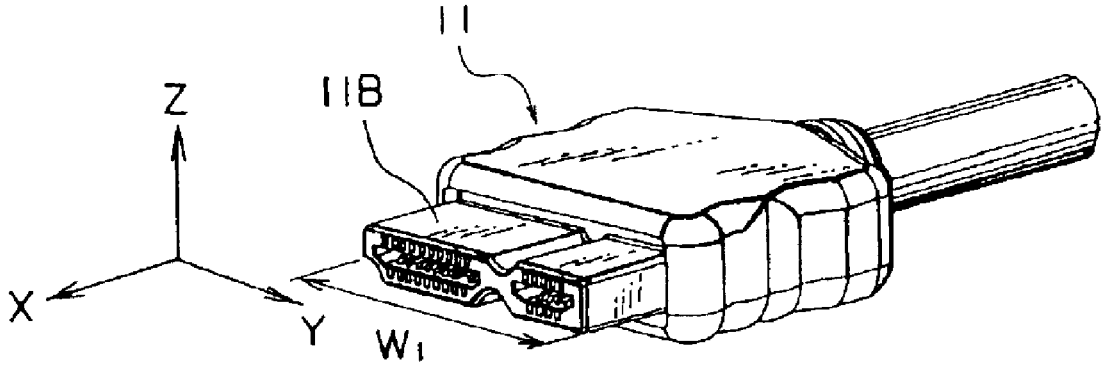
FIG. 8 is a perspective view showing a larger sized plug connector as a mating connector for the connector shown in FIG. 7.

With reference to FIGS. 6 to 8, a receptacle connector 1 according to a first embodiment of the present invention can accommodate therein either a plug connector 11 having a width $W_1$ or a plug connector 12 having a width $W_2$, both plug connectors 11 and 12 being covered by hoods 11A and 12A, respectively. Especially, the larger plug connector 11 has a connector interface or an interface hole which comprises two interface portions different in shape from each other, while the smaller plug connector 12 has a connector interface corresponding to one of the interface portions of the connector 11.

The connector 1 comprises an insulator 2, a plurality of contacts 3 supported by the insulator, and a shell 4 covering the insulator 2 and the contacts 3. The shell 4 defines a connector interface or interface hole on one end thereof in an insertion direction, namely an X-direction in FIG. 7.

Specifically, the shell 4 comprises two partitioning portions 4A which serve as partition means or mechanism. The partitioning portions 4A are formed integrally with the shell 4, by denting the top and bottom surface of the shell 4 toward inside of the shell 4. In another point of view, the partitioning portions 4A are upper and lower dented projections facing each other in a Y direction perpendicular to the insertion direction X, and serve to partition the connector interface into two interface portions, in cooperation with each other, resulting in that one of the interface portions has a shape different from the other one of the interface portions. In the embodiment shown in the figure, the interface hole is not completely but generally or functionally separated by the upper and lower dented projections which project to but short of each other. However, those upper and lower dented projections can be formed to project to contact with each other to thereby completely divide the interface hole into two interface portions.

The partitioning portions 4A also serve to securely guide a mating connector into the shell 4 when the larger plug connector 11 is inserted as the mating connector into the connector 1. If the mating connector is the smaller plug connector 12, the partitioning portion serves to avoid damage due to a local force generated by connecting the smaller plug connector to the connector 1. In addition, both interface portions have edge surfaces arranged in the same plane, as clearly seen from FIG. 7.

The shell 4 further comprises six contact portions 4B, three of which are formed on the bottom surface within the shell 4, the other being formed on the top surface within the shell 4. The contact portions 4B serve to a ground contact and make a secure ground connection between the shell 4 and another shell of the plug connector, for example, a shell 11B shown in FIG. 8, when the receptacle connector 1 and the plug connector 11, 12 are connected with each other.

Figure 9:
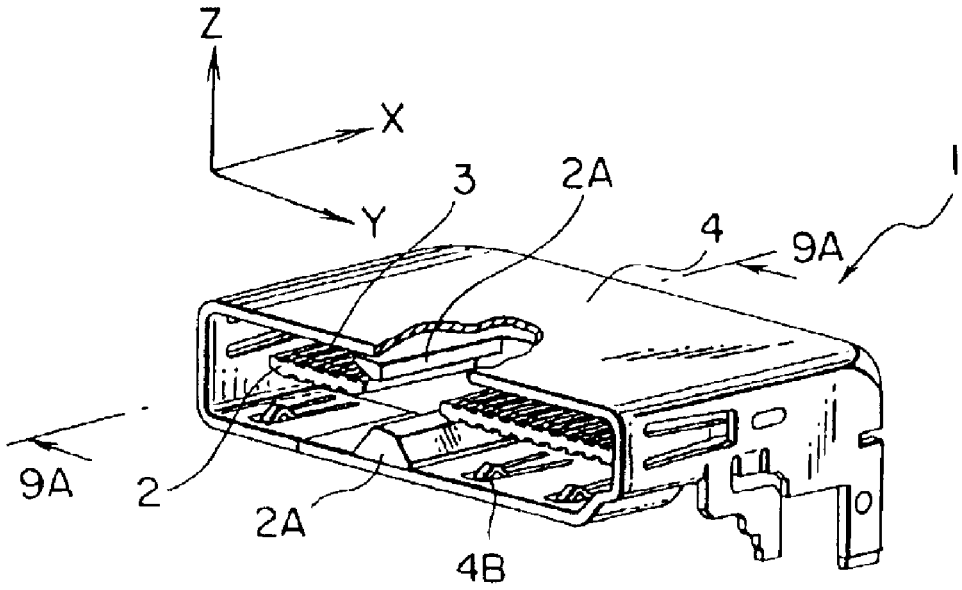
FIG. 9 is a perspective view showing a connector as a modification of the connector illustrated in FIG. 7, with a shell being shown partially broken away.
Figure 9A:
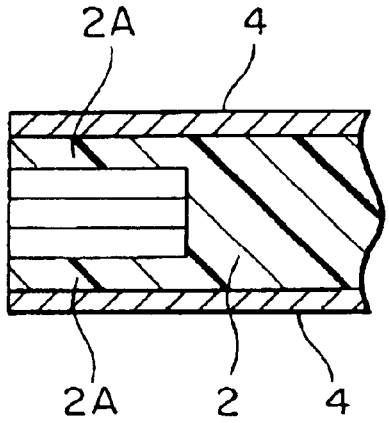
FIG. 9A is a sectional view taken along a line 9A—9A in FIG. 9.

FIG. 9 shows a modification of the receptacle connector 1 illustrated in FIG. 7. In the connector shown in FIG. 9, the partition means or mechanism comprises two upper and lower partitioning insulator portions 2A instead of the upper and lower dented projections 4A. Referring to FIG. 9A, the partitioning insulator portions 2A are formed integrally with the insulator 2 so as to extend respectively from upper and lower portions of the insulator 2 in the insertion direction, namely the X direction, along the upper and lower inner surface of the interface hole of the shell 4. That is, in this modification, the shell 4 itself does not have the partitioning portions 4A and also is not dented to form the partitioning portions 4A.

Figure 10:
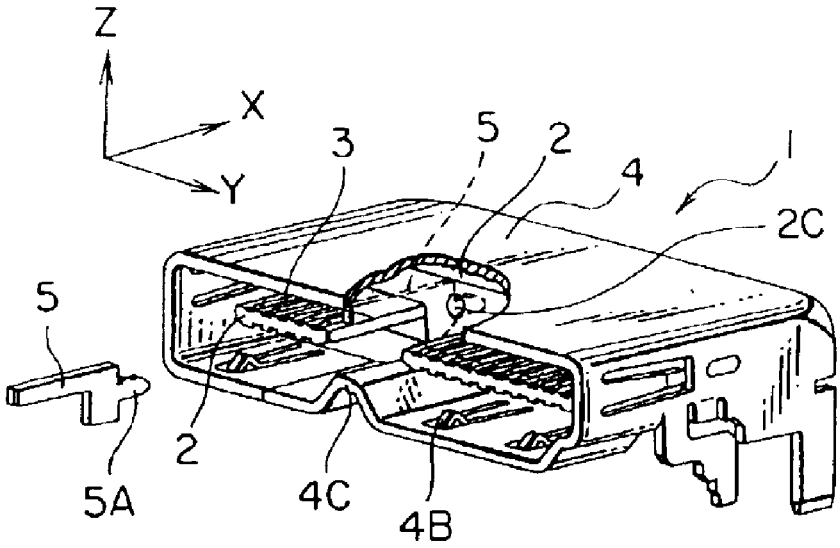
FIG. 10 is a perspective view showing a connector as another modification of the connector illustrated in FIG. 7, with a shell being shown partially broken away.
Figure 10A:
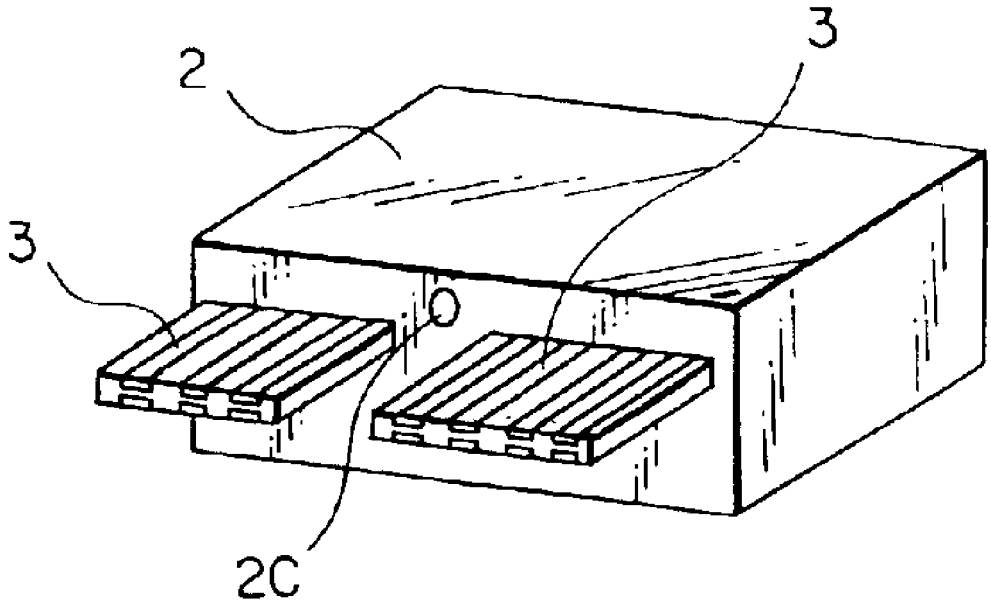
FIG. 10A is a perspective view of an insulator with a shell being removed.

FIGS. 10 and 10A show another modification of the receptacle connector 1 illustrated in FIG. 7. In the connector shown in FIG. 10, the partition means or mechanism is achieved by a lower dented projection 4C and a partitioning piece 5 instead of the upper dented projection 4A. The lower dented projection 4C is formed integrally with the shell 4 by denting the bottom surface of the shell 4 toward inside of the shell 4, while the partitioning piece 5 is a member separated from the shell 4 and the insulator 2. The partitioning piece 5 may be made of the same material as one of the insulator 2 and the shell 4. The partitioning piece 5 has a projection 5A to be pressed and inserted into a hole 2C formed on the insulator 2, so as to fix itself within the shell 4. In cooperation with the lower dented projection 4C, the fixed partitioning piece 5 serves to partition a connector interface into two interface portions as mentioned above.

In the above-mentioned structure according to the first embodiment or the modification thereof, the partition means or mechanism (4A, 2A, 4C, 5) does not completely divide the connector interface but only substantially partition the connector interface because the larger plug connector 11 has an integral connector interface as shown in FIG. 8. On the other hand, a receptacle connector according to a second embodiment has a structure that partition means or mechanism completely divides the connector interface.

Figure 11:
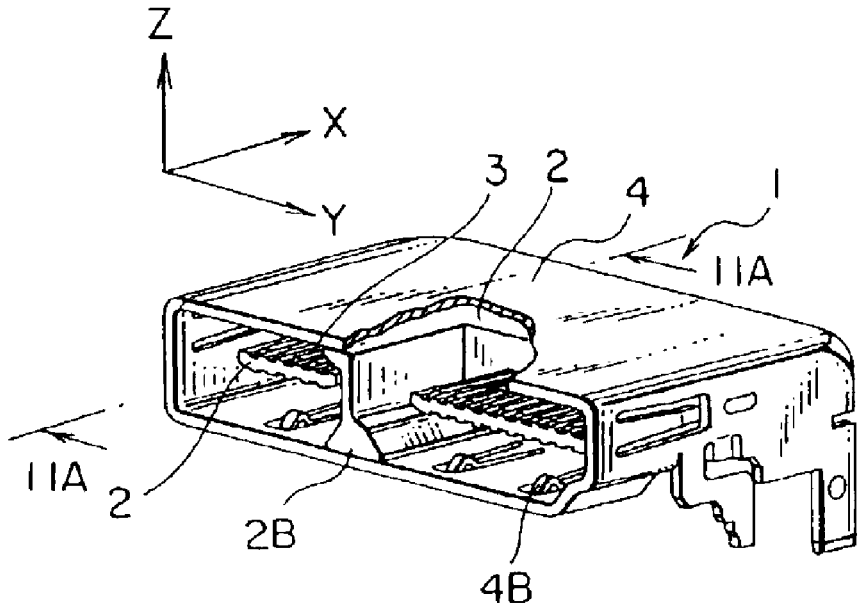
FIG. 11 is a perspective view showing a receptacle connector according to second embodiment, with a shell being shown partially broken away.
Figure 12:
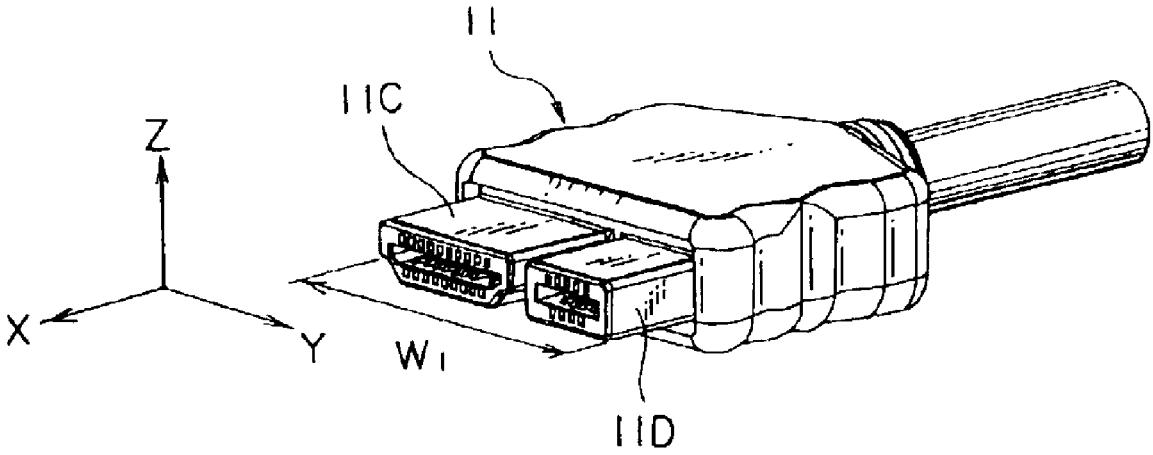
FIG. 12 is a perspective view showing a larger sized plug connector as a mating connector for the connector shown in FIG. 11.

With reference to FIGS. 11 and 12, the receptacle connector 1 of the second embodiment comprises an insulator 2, a plurality of contacts 3, and a shell 4, similar to the above-mentioned first embodiment. In addition, six contact portions 4B are also formed in the same manner of the first embodiment. The receptacle connector 1 can accommodate therein either a larger plug connector 11 or a smaller plug connector 12, wherein the larger plug connector has two shells 11C and 11D as shown in FIG. 12 and the smaller plug connector has an interface corresponding to one of the shells 11C and 11D.

Figure 11A:
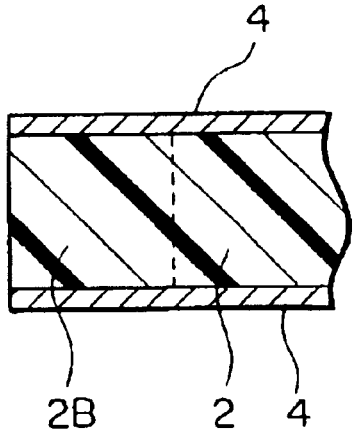
FIG. 11A is a sectional view taken along a line 11A—11A in FIG. 11.

Specifically, referring to FIGS. 11 and 11A, the connector 1 of this embodiment comprises as partition means or mechanism a partitioning wall portion 2B which is formed integrally with the insulator 2 and extends therefrom along and in contact with the upper and lower surface within the interface hole of the shell 4. As clearly seen from FIG. 11, the partitioning wall portion 2B completely partitions the connector interface into two interface portions in a Y-Z plane, namely, a plane perpendicular to the insertion direction (X direction).

Figure 13:
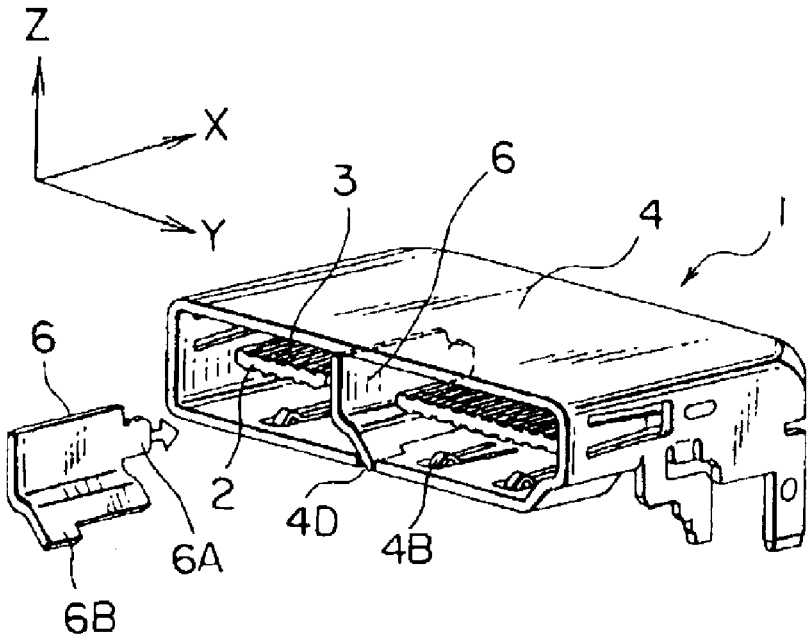
FIG. 13 is a perspective view showing a connector as a modification of the connector illustrated in FIG. 11.

FIG. 13 shows a modification of the receptacle connector 1 illustrated in FIG. 11. In the connector shown in FIG. 13, the partition means or mechanism comprises a partitioning wall piece 6 instead of the partitioning wall portion 2B. The partitioning wall piece 6 is a member which is separated from the shell 4 and the insulator 2 and which is for example made of the same material as one of the insulator 2 and the shell 4. The partitioning wall piece 6 has a projection 6A and a lug or tab 6B. On the other hand, the insulator 2 has a hole corresponding to the projection 6A and the shell 4 has a slit corresponding to the lug or tab 6B. In the manufacturing process, the projection 6A is pressed and inserted into the hole of the insulator 2 while the lug or tab 6B is fitted to the slit 4D, so that the partitioning wall piece 6 is fixed within the shell 4.

Figure 14:
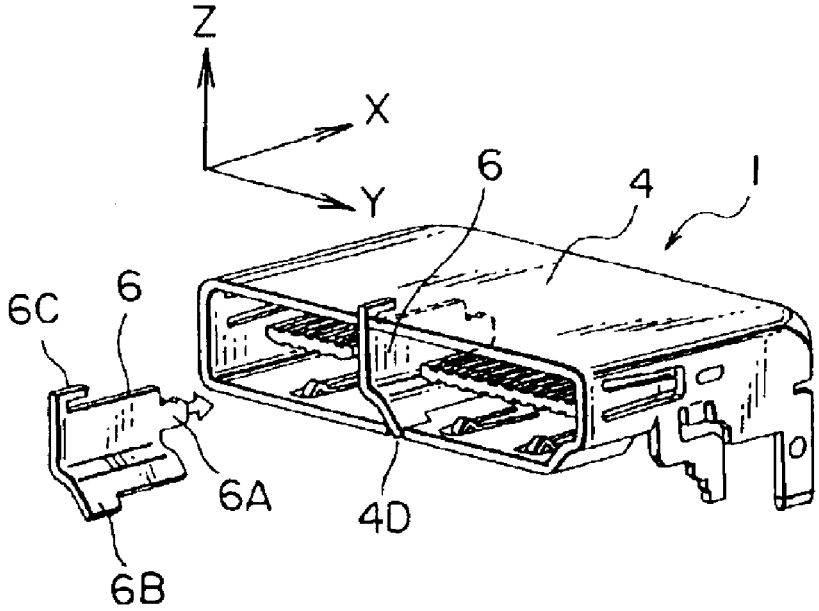
FIG. 14 is a perspective view showing a connector as another modification of the connector illustrated in FIG. 11.

In the modification of the receptacle connector, the partitioning piece 6 may further comprise an engaged portion 6C as shown in FIG. 14. The engaged portion 6C has an L-like shape and projects from the end opposite to the lug or tab 6B. The engaged portion 6C serves to be engaged with the top surface of the shell 4 when the partitioning piece 6 is inserted and fitted into the shell 4.

In the above-mentioned structure according to the second embodiment or the modification thereof, the partition means or mechanism (2B, 6) completely and physically divides the connector interface into two interface portions. In the next embodiment, partition means or mechanism also divides the connector interface into a plurality of sections completely and physically. That is, the receptacle connector according to the next embodiment can handle the type of larger plug connector shown in FIG. 12.

Figure 15:
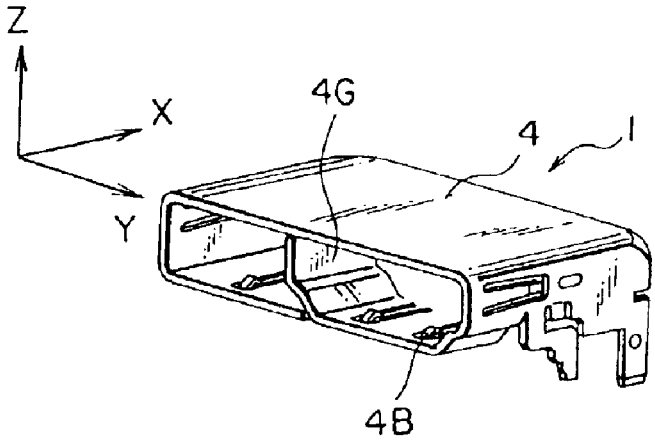
FIG. 15 is a perspective view showing a receptacle connector according to the third embodiment.

With reference to FIG. 15, although the receptacle connector 1 according to a third embodiment of the present invention comprises an insulator 2, a plurality of contacts 3, and a shell 4, similar to the abovementioned first embodiment, the insulator 2 and contacts 3 are not shown in the figure for the purpose of simplification of the drawing. In addition, six contact portions 4B are also formed in the same manner of the first embodiment. The receptacle connector 1 can accommodate therein either a larger plug connector 11 or a smaller plug connector 12, wherein the larger plug connector has two shells 11C and 11D as shown in FIG. 12 and the smaller plug connector has an interface corresponding to one of the shells 11C and 11D.

Specifically, the receptacle connector 1 of this embodiment comprises as partition means or mechanism a partitioning wall portion 4G which is formed integrally with the shell 4. As clearly understood from FIG. 15, the partitioning wall portion 4G completely partitions the connector interface into two interface portions in a Y-Z plane, namely, a plane perpendicular to the insertion direction (X direction). In the manufacturing process, shell material such as metal is bent at the center of the bottom surface of the shell, and the edge of the bent portion is forced to contact with the inner upper surface of the shell 4, so that the above-mentioned partition wall portion 4G is obtained.

Figure 16:
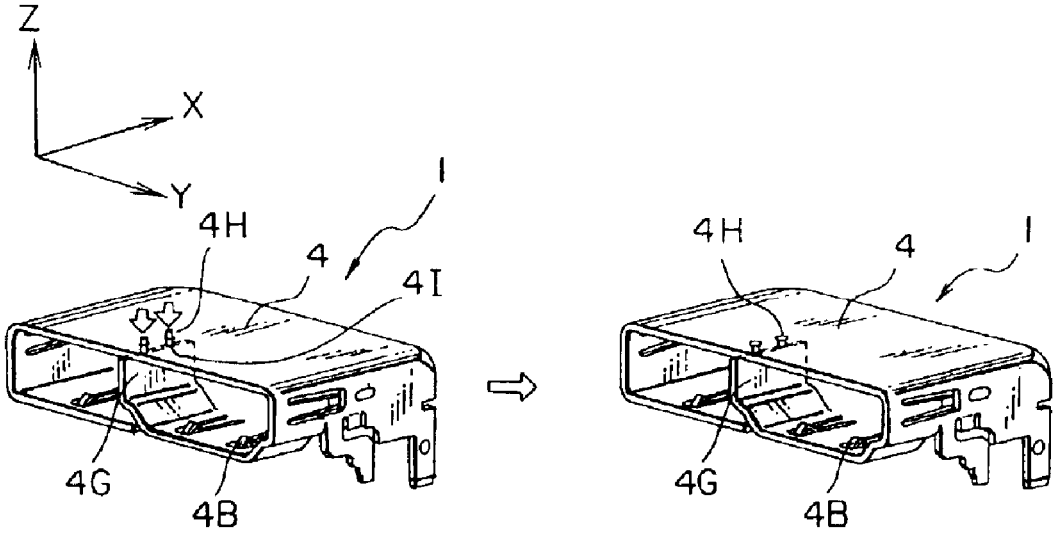
FIG. 16 is a perspective view showing a connector as a modification of the connector illustrated in FIG. 15.

In the connector of the third embodiment, the partitioning wall portion 4G may further have protrusions 4H as shown in FIG. 16. In the manufacturing process, the protrusions 4H are inserted into holes 41 formed in the upper wall of the shell 4, and then are mauled or deformed by hammer or something, so that the partitioning wall portion 4G is fixed within the shell 4.

Figure 17:
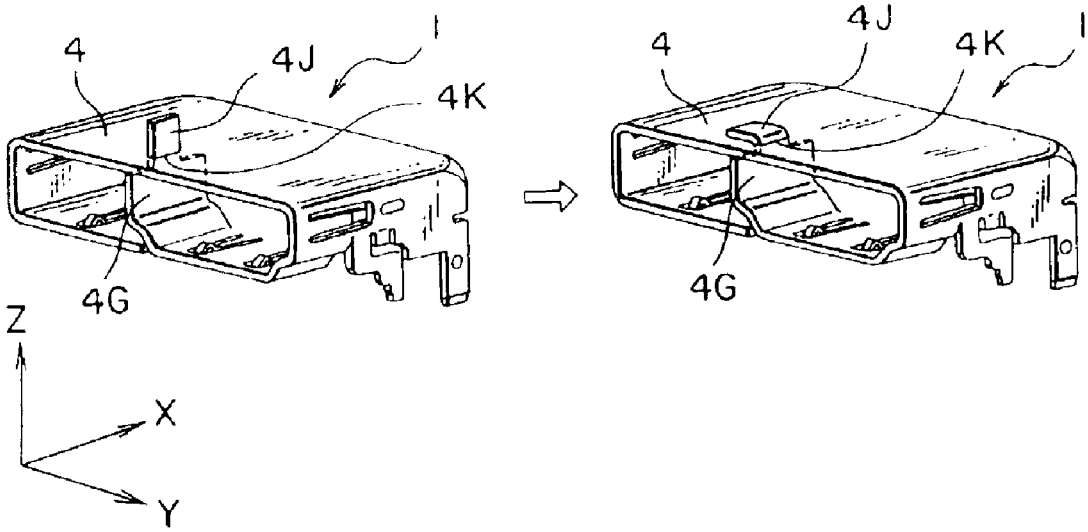
FIG. 17 is a perspective view showing a connector as another modification of the connector illustrated in FIG. 15.
Figure 18:
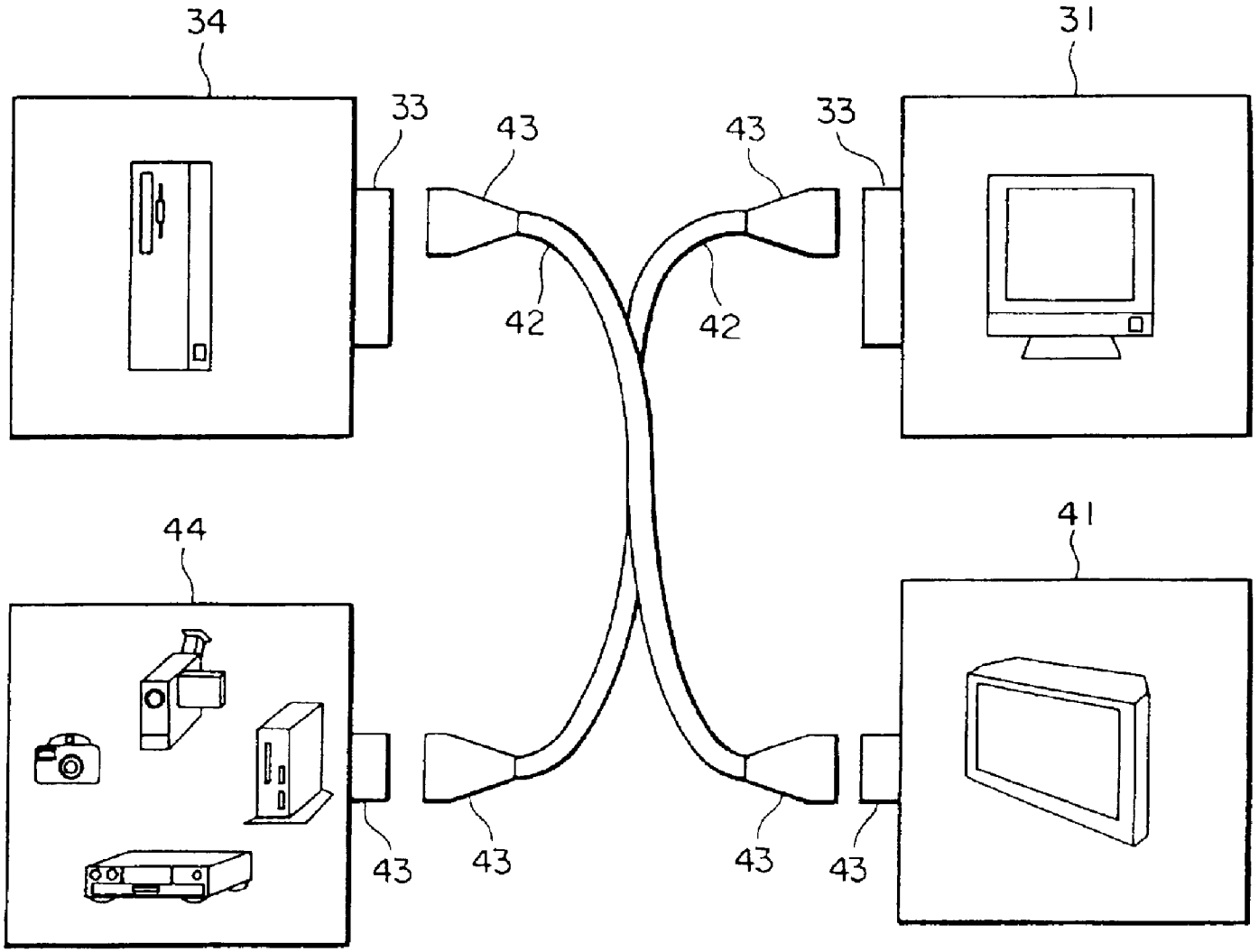
FIG. 18 is a view schematically showing connections in the embodiments of the present invention, one of which relates to the connection between a low resolution display and a high resolution instrument, while the other relates to the connection between a high resolution display and a low resolution instrument.

Also, the partitioning wall portion 4G may further have a tab or lug 4J in place of the protrusions, as shown in FIG. 17. In the manufacturing process, the tab 4J is inserted into a slit 4K formed in the upper wall of the shell 4, and then is bent, so that the partitioning wall portion 4G is fixed within the shell 4.

Consider here that the above-mentioned connectors are applied to the configuration illustrated in FIG. 1. In that case, all connection mentioned with reference to FIG. 1 can be established naturally. In addition, the connector 22 may be directly connected to the connector 30, provided the interface of the connector 30 is partitioned into at least two parts, and one of the parts corresponds to the interface of the connector 20.

Next, consider that a user wants to connect the high resolution instrument 34 to the low resolution display 41, or to connect the low resolution instrument 44 to the high resolution display 31. As seen from FIG. 18, both connections are established by the cable 42 for low resolution transmission, where neither dongle connector nor special cable as shown in FIG. 4 is required.

A general description of the present invention as well as preferred embodiments of the present invention has been set forth above. Those skilled in the art to which the present invention pertains will recognize and be able to practice additional variations in the connector which fall within the scope or teachings of this invention. For example, although the number of interface portions is two in the preferred embodiment of the present invention, the number of interface portions may be three or more. That is, the partition means or mechanism may be designed and arranged so as to partition the connector interface into a plurality of interface portions, one of the interface portions having a shape different from another one of the interface portions.

Now, description is made about the technical contribution of the present invention.

First, the present invention can resolve existing inconvenience of a notebook computer user when the user wants to connect a peripheral device to the notebook computer. In convention, there is an instrument or apparatus having a connector on which multiple functions including a standardized connector function are implemented. According to the present invention, a standardized mating connector is allowed to connect to only the standardized connector function of the multi-function connector, by using the connector space which is in essential arranged to provide the multiple functions. For example, in the above-mentioned case of FIG. 1, a notebook computer to be connected to a docking station is provided with a connector which has multiple functions. According to the present invention, a multi-function connector of a notebook computer can be used efficiently. In detail, a multi-function connector of a notebook computer is used entirely when the notebook computer is connected to a docking station and so on. On the other hand, when a notebook computer is connected to a peripheral device having a standardized connector, the standardized connector of the peripheral device can be connected to a part of a multi-function connector of the notebook computer without a special member such as a dongle connector.

Second, the present invention can harmonize a PC market and another consumer market such as TV, VIDEO, DVC, DVD, or GAME market with the simplest way. In a consumer market such as TV, VIDEO, DVC, DVD, or GAME market, a low resolution display is mainly used. Therefore, a low resolution instrument and a low resolution display can adopt a connector having signal pins, the number of which is minimum one necessary to transmit low resolution signals. On the other hand, a PC market has to handle a high resolution display and requires adopting a connector having signal pins necessary to transmit high resolution transmission. Note that, according to the prior art, a dongle connector or a special cable is required as mentioned with FIGS. 4 and 5. On the contrary, according to the present invention, a connector for high resolution transmission can handle, as a mating connector, not only a connector for high resolution transmission but also a connector for low resolution transmission. Therefore, both markets are harmonized with each other only by adopting concept of the present invention without a dongle connector or a special cable.

What is claimed is:

1. A connector comprising:

a plurality of contacts;

an insulator supporting said plurality of contacts; and a shell material forming:

a shell extending to surround said contacts and said insulator and defining a connector interface; and a partition mechanism extending successively from said shell into said connector interface to partition said connector interface into a plurality of interface portions, one of said interface portions having a shape different from another one of said interface portions, said interface portions being adapted for connecting interface portions of different mating connectors, respectively, while a combination of said interface portions being adapted for connecting an interface portion of a single mating connector.

2. The connector as claimed in claim 1, wherein the contacts, said insulator, said shell and said partition mechanism are designed and arranged so as to be suitable for use in a serial transmission system.

3. The connector as claimed in claim 1, wherein said contacts, said insulator, said shell and said partition mechanism are designed and arranged so as to be suitable for use in a TMDS, LVDS or GVIF system.

4. The connector as claimed in claim 1, wherein said contacts, said insulator, said shell and said partition mechanism are designed and arranged for a case where a mating connector for the connector is connected to a graphic display device.

5. The connector as claimed in claim 1, wherein said partition mechanism is designed and arranged so that a mating connector can be smoothly and securely guided to the connector in a connection process.

6. The connector as claimed in claim 1, wherein said shell is designed so that one of the interface portions is arranged in the same plane as another one of the interface portions.

7. The connector as claimed in claim 1, further comprising at least one contact portion on an inner surface of said shell for establishing secure contact between said shell of said connector and a shell of a mating connector, when said mating connector is inserted into said connector.

8. The connector as claimed in claim 1, wherein said partition mechanism has an end forced to contact with an inner surface of the shell.

9. The connector as claimed in claim 1, wherein said shell has a hole, said partition mechanism having a protrusion which is fitted in said hole and fixed to said shell.

10. The connector as claimed in claim 9, wherein said protrusion has a portion which is deformed at an outside of said shell to be engaged with said shell.

11. The connector as claimed in claim 1, wherein said shell has a slit, said partition mechanism having a tab which is fitted in said slit and fixed to said shell.

12. The connector as claimed in claim 11, wherein said lug has a portion which is bent at an outside of said shell to be engaged with said shell.

* * * * *